US006322402B1

(12) United States Patent
Chadbourne et al.

(10) Patent No.: US 6,322,402 B1
(45) Date of Patent: Nov. 27, 2001

(54) INSULATION PIERCING WEDGE CONNECTOR WITH SNAP IN BLADES

(75) Inventors: Richard Chadbourne, Merrimack; Armand T. Montminy, Manchester, both of NH (US)

(73) Assignee: FCI USA, Inc., Fairfield, CT (US)

( * ) Notice: Subject to any disclaimer, the term of this patent is extended or adjusted under 35 U.S.C. 154(b) by 0 days.

(21) Appl. No.: 09/605,914

(22) Filed: Jun. 28, 2000

(51) Int. Cl.[7] ..... H01R 4/50
(52) U.S. Cl. ..... 439/783; 439/425
(58) Field of Search ..... 439/783, 595, 439/785, 807, 425; 403/737, 374.1, 374.2, 256

(56) References Cited

U.S. PATENT DOCUMENTS 5,679,031 10/1997 Chadbourne et al. ..... 439/783
5,911,604 6/1999 Chadbourne ..... 439/783
5,944,564 * 8/1999 Chadbourne et al. ..... 439/783
6,048,226 * 4/2000 Iwahori ..... 439/595

FOREIGN PATENT DOCUMENTS 0810688 3/1997 (EP) .
2065994 7/1981 (GB) .

* cited by examiner

*Primary Examiner*—Renee Luebke
*Assistant Examiner*—Felix O. Figueroa
(74) *Attorney, Agent, or Firm*—Perman & Green, LLP

(57) ABSTRACT

An electrical wedge connector comprising a shell, a wedge section sized and shaped for being inserted into the shell, and at least one elongated bar element. The wedge section is inserted into the shell for connecting two electrical conductors to each other. The wedge section has at least one passageway formed therethrough. The elongated bar element is mounted to the wedge section. The elongated bar element is located in said at least one passageway of the wedge section. The elongated bar element has piercing protrusions for effecting an electrical connection between each of the two conductors and the elongated bar. The wedge section includes at least one stop member for retaining the elongated bar element to the wedge section in at least one direction.

20 Claims, 5 Drawing Sheets

INSULATION PIERCING WEDGE CONNECTOR WITH SNAP IN BLADES

BACKGROUND OF THE INVENTION

1. Field of the Invention

The present invention relates to electrical wedge connectors and, more particularly, to electrical wedge connectors with blades for piercing conductor insulation.

2. Prior Art

European Patent Office publication No. EP0810688 discloses a wedge connector for piercing through insulated conductors. U.K. patent publication No. 2065994 also discloses a wedge connector with a wedge capable of piercing through insulation on a conductor. U.S. Pat. No. 5,679,031 discloses retention barbs on a wedge connector shell. U.S. Pat. No. 5,911,604 discloses an insulation piercing wedge connector with seal.

SUMMARY OF THE INVENTION

In accordance with a first embodiment of the present invention, an electrical wedge connector is provided. The electrical wedge connector comprises a shell, a wedge section, and at least one elongated bar element. The wedge section is sized and shaped for being inserted into the shell for connecting two electrical conductors to each other. The wedge section has at least one passageway formed therethrough. The elongated bar element is mounted to the wedge section. The elongated bar element is located in said at least one passageway of the web section. The elongated bar element has piercing protrusions for effecting an electrical connection between each of the two conductors and the elongated bar. The wedge section includes at least one stop member for retaining the elongated bar element to the wedge section in at least one direction.

In accordance with a second embodiment of the present invention, an electrical wedge connector is provided. The electrical wedge connector comprises a shell, and a wedge assembly. The wedge assembly is sized and shaped for being inserted into the shell for connecting two electrical conductors to each other. The wedge assembly comprises a wedge block, and an elongated bar element located in a passageway formed in the wedge block. The elongated bar element has piercing protrusions for piercing the two conductors, and electrically connecting the two conductors to the elongated bar element. The elongated bar element includes a resilient sheath. The elongated bar element has a first configuration in which the piercing protrusions of the elongated bar element are at least partially hidden in the resilient sheath, and a second configuration in which the piercing protrusions are exposed out of the resilient sheath.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
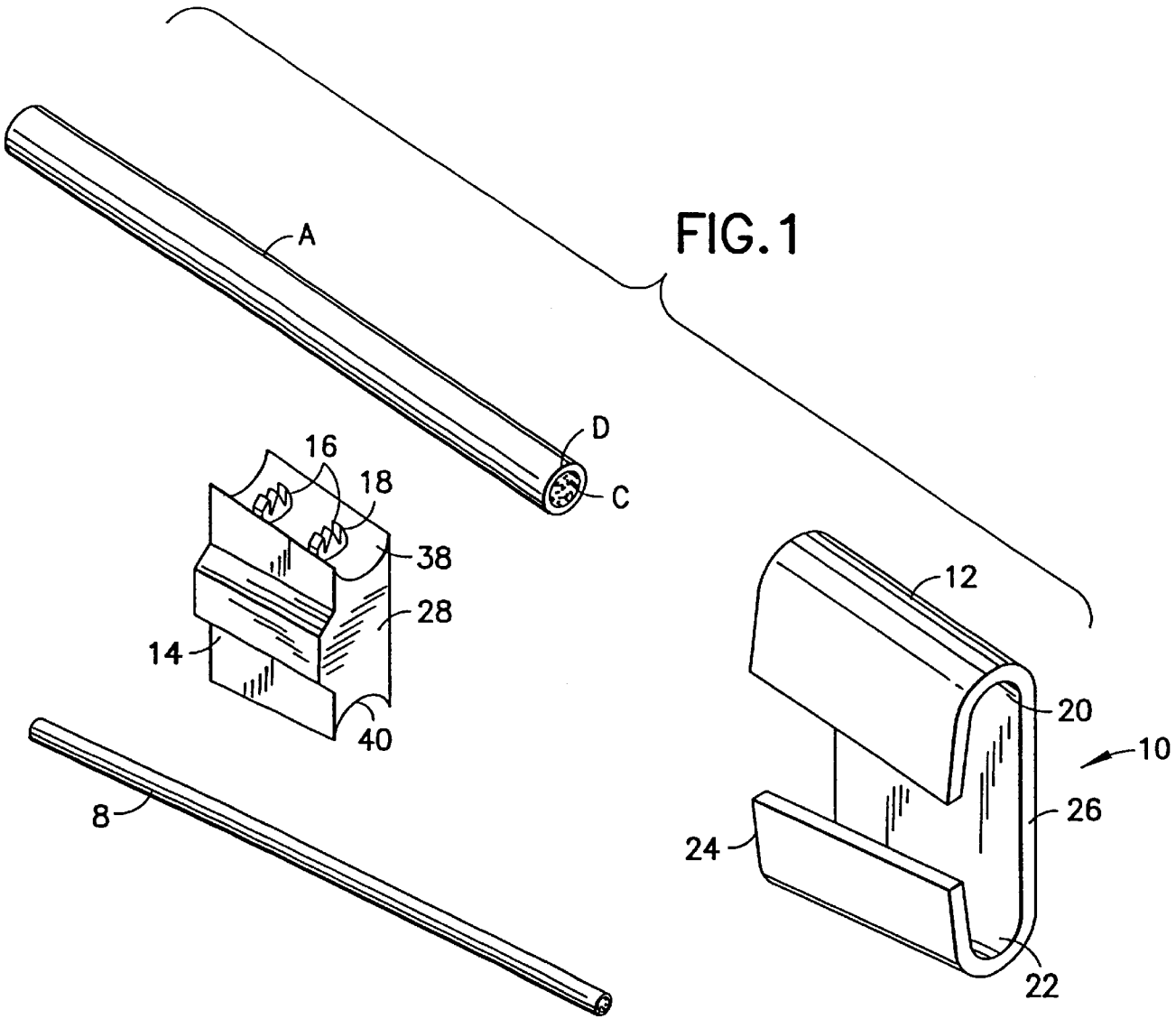
FIG. 1 is an exploded perspective view of an electrical wedge connector incorporating features of the present invention.

Referring to FIG. 1, there is shown an exploded perspective view of an electrical wedge connector 10 incorporating features of the present invention, and two conductors A, B. Although the present invention will be described with reference to the single embodiment shown in the drawings, it should be understood that the present invention can be embodied in many alternate forms of embodiments. In addition, any suitable size, shape or type of elements or materials could be used.

The conductors A, B, generally comprise an inner electrical conductive section C and an outer layer D of electrically insulating material. The electrical wedge connector 10 generally comprises a shell 12 and wedge assembly 14. The wedge assembly 14 includes elongated bar elements 16 with insulation piercing protrusions 18. The wedge assembly 14 is inserted into the shell 12 between insulated conductors A, B. The conductors A, B are thus captured in shell 12 by wedge assembly 14 thereby connecting the conductors to each other. Insertion of the wedge assembly 14 against the conductors A, B in the shell 12 causes the piercing protrusions 18 to pierce the insulating layer D of the conductors and effect an electrical connection between the piercing protrusions and conductors.

The electrical wedge connector 10 is similar to the wedge connector described in U.S. Pat. No. 5,911,604 which is incorporated by reference herein in its entirety. Referring still to FIG. 1, the shell 12 of the wedge connector 10 has a general "C" shape forming two conductor receiving channels 20, 22 at opposite top and bottom sides of the shell. The shell 12 is tapered from rear 24 to front 26 to form a general wedge shape profile. In alternate embodiments, the shell of the wedge connector may have any other suitable shape.

Figure 2:
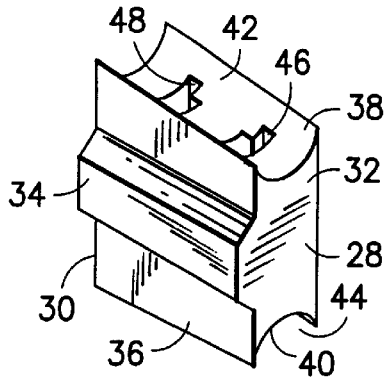
FIG. 2 is a perspective view of a wedge section of the electrical wedge connector in FIG. 1 in accordance with a first preferred embodiment of the present invention.
Figure 3:
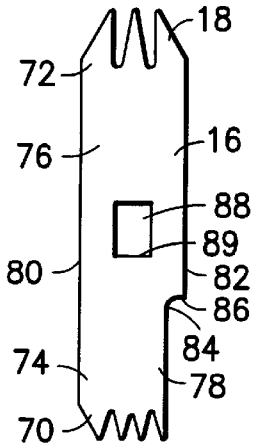
FIG. 3 is a side elevation view of an elongated bar element of the wedge connector in FIG. 1.

Referring now also to FIGS. 2 and 3, in accordance with the first preferred embodiment of the present invention, the wedge assembly 14 comprises a wedge block or wedge section 28 (a perspective view of which is shown in FIG. 2), and two elongated bar elements 16. In alternate embodiments, the wedge assembly may have any suitable number of elongated bar elements in the wedge section. An elevation view of an elongated bar element 16 is shown in FIG. 3. The wedge section 28 is preferably a one piece member made from a suitable conductive, or dielectric material. For example, the wedge section 28 may be made from a hard plastic material such as glass filled plastic. The wedge section 28 is also tapered from rear 30 to front 32 to generally conform to the tapered shape of the shell. A rib or projection 34 extends from a lateral side 36 of the wedge section (see FIG. 2). The opposite top and bottom sides 38, 40 of the wedge section 28 are curved inwards forming conductor receiving areas 42, 44. In the preferred embodiment the wedge section 28 has two channels 46, 48 formed therethrough for elongated bar elements 16.

Figure 2A:
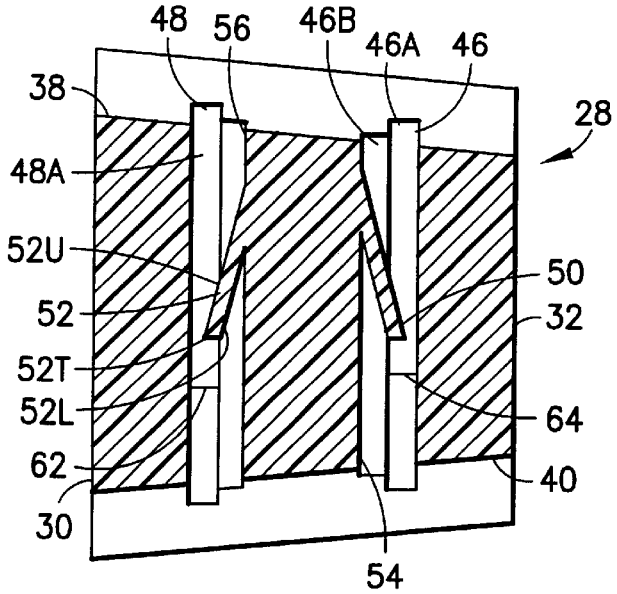
FIGS. 2A–2B are respectively a cross-sectional elevation view of the wedge section taken through line 2A—2A in FIG. 2B, and a top plan view of the wedge section in FIG. 2.
Figure 2B:
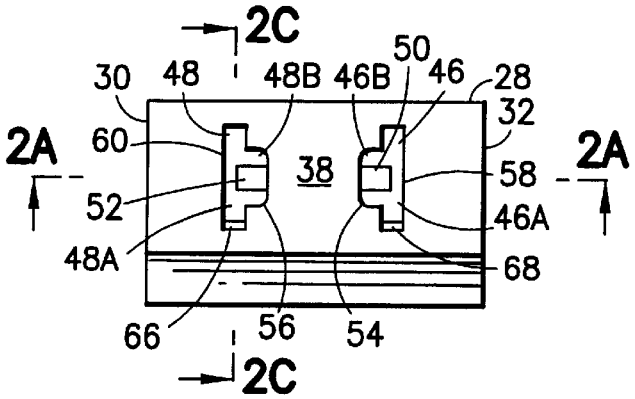
Figure 2C:
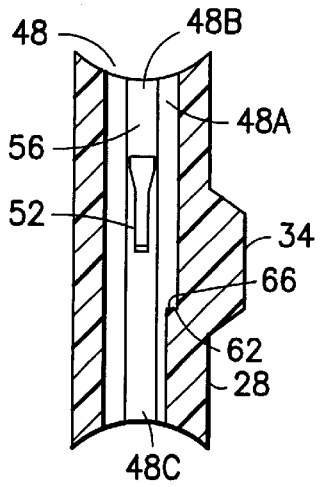
FIG. 2C is a cross-sectional elevation view of the wedge section taken through line 2C—2C in FIG. 2B.

Referring now to FIGS. 2A–2B, there is shown respectively a cross-sectional elevational view, and the top plan view of the wedge section 28. The cross sectional view in FIG. 2A is taken along line 2A—2A in FIG. 2B. In accordance with the first preferred embodiment of the present invention, the two channels 46, 48 are disposed longitudinally next to each other. The channels 46, 48 extend from the top 38 to the bottom 40 of the wedge section 28. As seen best in FIG. 2B, in the preferred embodiment, each channel 46, 48 has a general "T" shaped cross section with a wider groove 46A, 48A communicating with a narrower slot 46B, 48B. The front and the rear channels 46, 48 are orientated in a mirror configuration with respect to each other (e.g. the bottoms 54, 56 of the channels 46, 48 are facing each other, and the tops 58, 60 respectively face the front and rear sides 32, 30 of the wedge section 28. In alternate embodiments, the channel cross section may have any other suitable shape. Each channel 46, 48 has a resilient lance or tab 50, 52 extending therein. The tab 50, 52 in each channel 46, 48 cantilevers from the bottom 54, 56 of the channel. Hence, in the preferred embodiment, the tabs 50, 52 are cantilevered away from each other (e.g. the tab 50 in the front channel 46 is cantilevered toward the front 32 of wedge section 28, and the tab 52 in the rear channel 48 is cantilevered towards the rear 30 of the wedge section). Both tabs 50, 52 are angled downwards towards the bottom 40 of wedge section 28 (see FIG. 2A) . The tabs 50, 52 are of sufficient length to project at least in part, into the wider grooves 46A, 48A of the channels 46, 48. Referring now also to FIG. 2C, there is shown a cross sectional view of the wedge section 28 taken along line 2C—2C in FIG. 2B. As can be seen in FIG. 2C, cantilever tab 52 in channel 48 has a generally tapered profile, with the base of the tab generally wider than the tip. The plan shape of tab 50 (not shown) in the front channel 46 is substantially similar to the profile shape of tab 52 shown in FIG. 2C. In alternate embodiments the tabs may have any other suitable profile. FIG. 2C also shows that channel 48 has a shoulder 62 formed in a side wall of wider groove 48A. The shoulder 62 defines upper stop surface 66 in rear channel 48. The shoulder 62 also defines a narrower portion 48C at the lower end of groove 48A. Similar to the rear channel 48 shown in FIG. 2C, the front channel 46 also has a shoulder 64 in the wider groove 46A of the channel (see FIG. 2A). As can be seen in FIG. 2C, the shoulder in channel 46 defines upper stop surface 68 in the channel. Also, the shoulder in channel 46 defines a narrower portion (not shown) at the lower end of groove 46A similar to portion 48C shown in FIG. 2C. The shoulders 64, 62 in channels 46, 48 are located below the tip of tabs 50, 54 though, the shoulders may be located vertically at any suitable height within channels 46, 48. In alternate embodiments, the upper stop surface in each channel may be formed by any suitable type of tab, detent, or protrusion formed on any of the walls of the wider grooves forming the channels in the wedge section.

Referring now to FIG. 3, the elongated bar element 16, of the present invention, is a one-piece member made from a suitable conductive material. The bar element 16 is preferably a plate member stamped from sheet metal. The bar element 16 has piercing teeth, or protrusions 18, 70 at opposite top and bottom ends 72, 74 of the bar. In the preferred embodiment, the protrusions 70 at one end 74 are smaller than the protrusions 18 at the other end 72. The piercing protrusions 18, 70 may be formed when stamping the bar element, or may be subsequently cut in the stamped bar. The bar element 16 has a wider upper section 76 and a narrower lower section 78 depending from the upper section. Thus, the shape of the bar element 16 generally conforms to the shape of the wider groove 46A, 48A in the channels 46, 48. The configuration of bar elements 16, as it relates to the channels 46, 48 in the wedge section 28, will be described in greater detail below with particular reference to channel 48 (see FIG. 2C), though the noted features apply equally to channel 46 and channel 48 of the wedge section. The upper section 76 is sized to slide freely in the vertical direction within the wider groove 48A of corresponding channel 48. The upper section 76 is too wide to be admitted into the narrower portion 48C at the lower end of groove 48A. The narrower section 78 of bar element 16 is sized to be admitted into the narrower portion 48C. As can be seen in FIG. 3, the upper portion 76, and narrower portion 78 are substantially flush along one side 80 of the bar element. The other side 82 of the bar element 16 has a cut-out or step 84 formed therein which defines a locating or snubbing surface 86. The snubbing surface 86 preferably faces the end of the bar element 16 with smaller size piercing protrusions 70. In the preferred embodiment, the bar element 16 has a locating aperture or port hole 88 extending through the bar element. The aperture 88 has a substantially rectangular shape with a generally flat lower lip 89. As can be seen in FIG. 3, aperture 88 is formed in the wider upper sections 76 of the bar element 16. In alternate embodiments, the locating aperture in the bar element may have any other suitable shape, such as for example, a blind recess, or step, and may be located at any suitable location on the bar element.

Referring now to FIGS. 2A–2C, and 3, the wedge assembly 14 is assembled by inserting bar element 16 into wider groove 48A of channel 48 in the wedge section 28. The bar element 16 is inserted into the wedge section from the top 38 with the narrow section 74 of the bar element being inserted first. The bar element 16 is orientated relative to the channel 48 so that the cut-out 84 in the bar element is on the side of the channel 48 with shoulder 62. The generally conformal configuration of the bar element 16 and of the wider groove 48A in channel 48 provide a polarization of the channel 48 to prevent insertion of the bar element 16 from the bottom 40 of the wedge section, or insertion with the wider section 76 first. Insertion of the bar element 16 into the groove 48A brings the bar element into contact with angled upper surface 52U of tab 52 projecting into groove 48A (see FIG. 2A). The angled upper surface 52U cooperates with the bar element to resiliently deflect tab 52, and allow the bar 16 to continue to be inserted. Insertion of bar element 16 into wedge section 28 is stopped when snubbing surface 86 abuts insertion stop surface 66 (see FIGS. 2B, 2C) in channel 48. In this position, the locating aperture 88 of bar element 16 is aligned with the end 52T of tab 52. This allows the deflected tab 52 to resile so that the end 52T and part of the tab 52 enter into the locating aperture 88 of bar element 16. With the tab 52 in locating aperture 88 of bar element 16, the bar element 16 is prevented from being removed from the wedge section 28. As can be realized from FIG. 2A, removal of bar element 16 by withdrawing the bar upwards brings the lower lip 89 of the locating aperture against the lower surface 52L of tab 52 protruding into the aperture. Thus, the tab 52 prevents the bar element 16 from being extracted from the top 38 of wedge section 28. As noted previously, further insertion of the bar element 16 downward into wedge section 28 is stopped by insertion stop surface 66 in the channel 48. Accordingly, the bar element 16 is captured in this position between tab 52 and stop surface 66. With the bar element 16 held in this position within the wedge section 28, the piercing protrusions 18, 70 of the bar element project outside the top and bottom 38, 40 of wedge section 28 as shown in FIG. 1 (FIG. 1 shows only the upper piercing protrusions 18 extending from the top 38 of wedge section 28 for example purposes). A second bar element 16 is inserted into channel 46 of the wedge section 28 in a manner substantially the same as that described above in order to complete the wedge assembly 14. The wedge assembly 14 may then be inserted into shell 12 of the connector 10 to connect conductors A and B to each other. During insertion of the wedge assembly 14 into the shell 12, the stop surface 66 stops downward insertion forces on the bar element 16 preventing the piercing protrusions 70 from over-piercing the smaller tap conductor B (see FIG. 1).

Figure 2D:
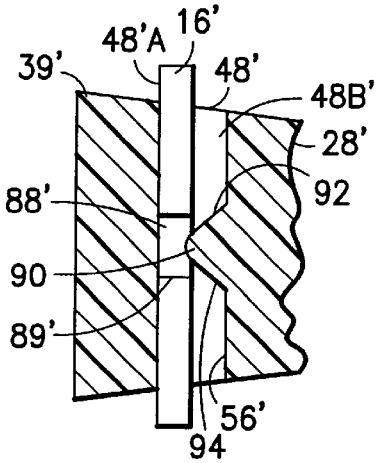
FIG. 2D is a partial cross-sectional elevation view of the wedge section in FIG. 2 in accordance with a second preferred embodiment of the present invention.

Referring now also to FIG. 2D, there is shown a partial cross sectional elevation view of a wedge section 28' in accordance with a second preferred embodiment of the present invention. Accept as otherwise noted, wedge section 28' depicted in FIG. 2D is substantially similar to wedge section 28 described previously, and shown in FIGS. 2A–2D, with similar features having similar reference numbers. In this preferred embodiment, the bar element receiving channel 48' (only one of the two channels of the wedge section is shown for example purposes) has a resilient detent 90 projecting from the bottom 56' of the channel into the wider groove 48A'. The detent 90 is provided with an upper cam or ramp surface 92. The lower surface 94 of the detent 90 is also angled, with an upward pitch in the preferred embodiment, though the lower surface of the detent may have a downward pitch, or otherwise the lower surface may be horizontally flat. The elongated bar element 16', in accordance with this preferred embodiment of the present invention, is also substantially similar to the bar element 16 described before with reference to FIG. 3. As shown in FIG. 2D, the elongated bar element 16' is inserted into the wider groove 48A' of channel 48', preferably from the top 38' of the wedge section 28'. As the bar element 16' is being inserted, it comes into contact with cam surface 92 of the detent 90. The cam surface 92 cooperates with the bar element 16' to resiliently cam the detent 90 and allow insertion of the bar element 16' into channel 48'. As the locating recess 88' becomes aligned with detent 90, the detent 90 is biased into the locating recess 88' thereby stopping further insertion of the bar element 16' into wedge section 28'. Alternatively, the wider groove 48A' of channel 48' may have a stop surface (not shown) positioned similar to stop surface 66 in FIG. 2C to stop insertion of bar element 16' in a position wherein the piercing protrusions on the bar element extend out of the top and bottom sides of the wedge section. The lower surface 94 of detent 92 engages the bottom lip 89' of locating recess 88' to prevent removal of the bar element 16' through the top 38' of the wedge section 28'. Accordingly, the detent 90 and the channel 48' restrains the bar element 16' from axial displacement in the channel.

Figure 4:
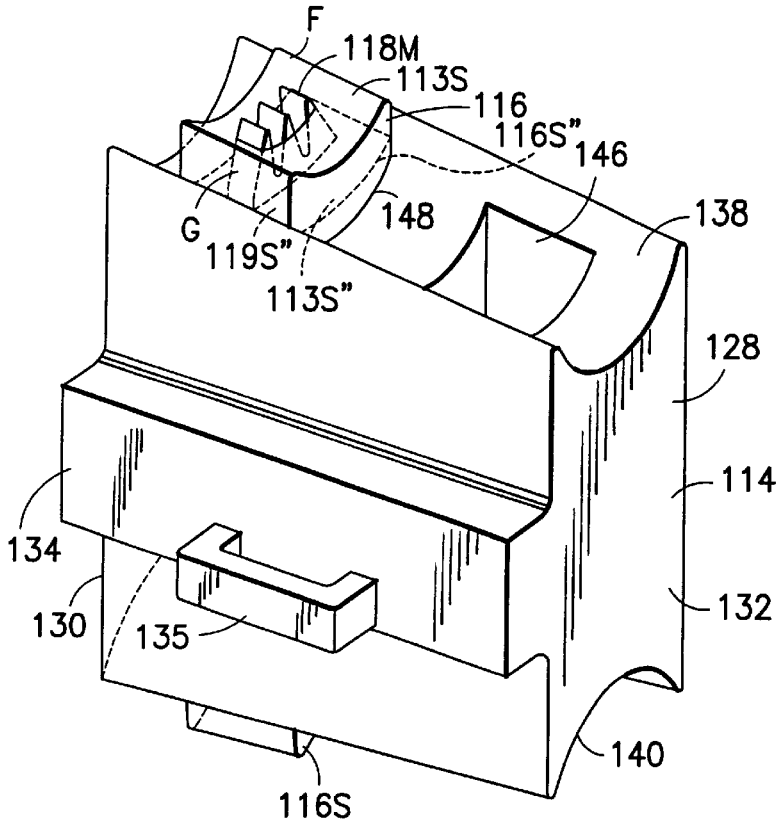
FIG. 4 is a perspective view of a wedge assembly for the electrical wedge connector in accordance with a third preferred embodiment of the present invention.

Referring now to FIG. 4, there is shown a perspective view of another wedge assembly 114 for the wedge connector in accordance with the third preferred embodiment of the present invention. The wedge assembly 114 in this embodiment is substantially similar to the wedge assembly 14 described previously, and shown in FIGS. 1, and 2A–2C, with similar features having similar reference numbers. The wedge assembly 114 includes a wedge section 128, and preferably, two elongated bar members 116 (only one bar member 116 is shown in FIG. 4 for example purposes). In alternate embodiments, the wedge assembly may have any suitable number of elongated bar elements mounted therein. As shown in FIG. 4, the elongated bar member 116 are housed in channels 146, 148. The top and bottom 138, 140 of the wedge section 128 are curved inwards to provide conductor receiving areas. The elongated bar member 116 extends out from the top 138 and bottom 140 of the wedge section 128. As shown in FIG. 4, the wedge section 128 has a lateral rib 134 with a push tab 135 depending therefrom.

Figure 5A:
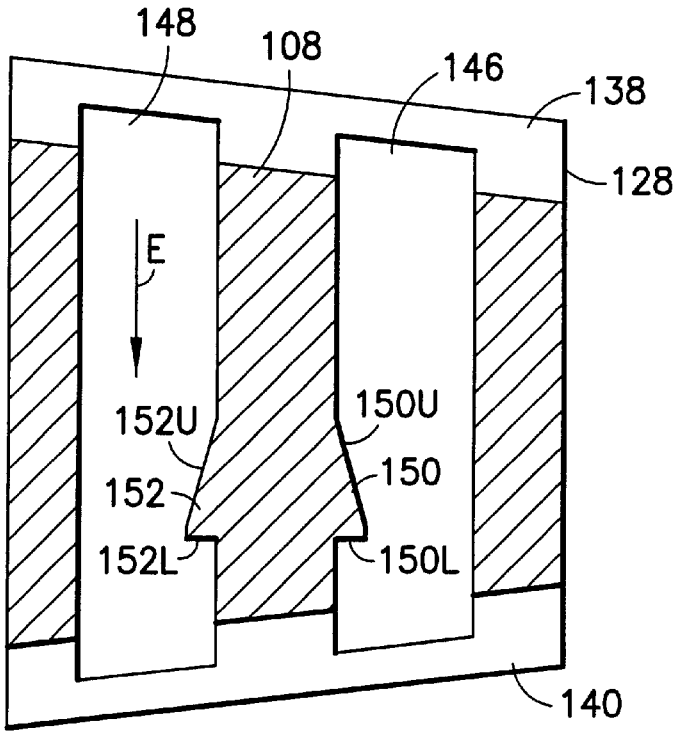
FIGS. 5A–5B are respectively a cross-sectional elevation view of a wedge section of the wedge assembly in FIG. 4, and a top plan view of the wedge section.
Figure 5B:
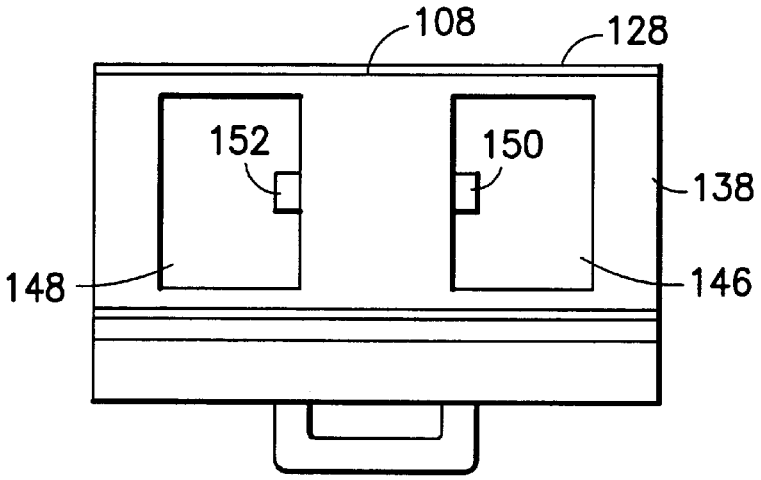

Referring now also to FIGS. 5A–5B, the channels 146, 148 in wedge section, for housing the elongated bar members 116, extend through the wedge section 128 from top 138 to bottom 140. The channels 146, 148 have a substantially rectangular cross section (see FIG. 5B).

As can be seen best in FIG. 5A, each channel 146, 148 has detents 150, 152 projecting into the channel 146, 148. The detents 150, 152 depend from a common web member 108 between the channels 146, 148. The upper surface 150U, 152U of the detents 150, 152 is sloped downwards. The lower surface 150L, 152L of the detents is generally aligned perpendicular (e.g. horizontal) to the direction of insertion of elongated bar element 116 into the channels 146, 148 indicated by arrow E in FIG. 5A). In alternate embodiments, the lower surface of the detents may have any other suitable pitch.

Figure 4A:
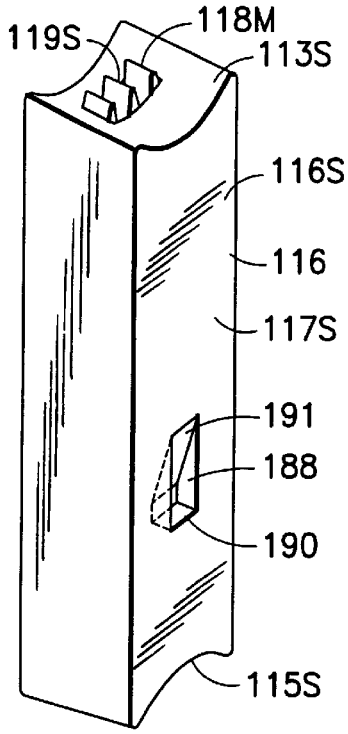
FIGS. 4A–4B are respectively a perspective view of an elongated bar element of the wedge assembly in FIG. 4, and a perspective view of a bar member included in the elongated bar element in FIG. 4A.
Figure 4B:
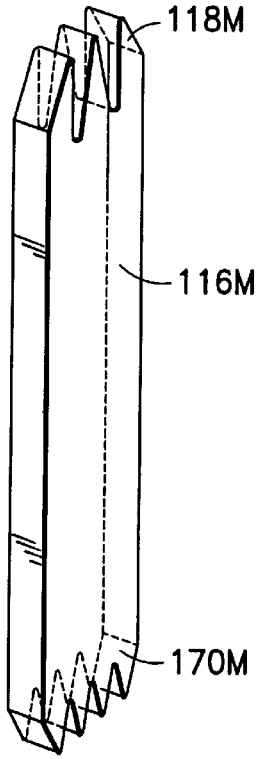

Referring now to FIGS. 4A–4B, the elongated bar element 116 preferably comprises a metal bar or plate 116M covered in a sleeve or sheath 116S. The metal bar 116M has piercing teeth or protrusions 118M, 170M at top and bottom opposite ends. The sheath 116S covering the metal bar 116M is made from a suitable insulation material such as for example, a rubber, or polymer material. The sheath 116S is preferably over-molded on the metal bar 116M, so that only the ends of piercing protrusions 118M, 170M extend out from openings 119S in the sheath (the lower opening is not shown in FIG. 4A). In alternate embodiments, the sheathing covering the metal bar may be formed in any other suitable manner and the metal bar inserted into the sheath. As can be seen in FIG. 4A, the resilient sheath 116S has curved top and bottom ends 113S, 115S generally conforming to the curvature of the top and bottom sides 138, 140 of the wedge section 128. Otherwise, the sheath 116S has a generally rectangular cross section adapted to fit within channels 146, 148. The resilient sheath 116S has a locating recess 188 formed therein. The locating recess 188 is formed in a side 117S of the sheath 116S, which side 1173 is orientated relative to the curvature of the top and bottom ends 113S, 115S to be aligned facing the front 132, or rear 130 of the wedge section 128 as desired (see FIG. 4). In alternate embodiments, the sheath of the elongated bar element may have two locating recesses formed on opposite sides of the sheath. The locating recess 188 complements the size and shape of the detents 150, 152 in channels 146, 148 of the wedge section. The upper surface 191 of the recess 188 is angled downwards and inwards. The lower surface 190 is substantially horizontal.

The elongated bar element 116 is inserted into the wedge section channels 146, 148 from the top down as indicated by arrow E in FIG. 5A. The flat lower surface 150L, 152L of detents 150, 152 in channels 146, 148, which is located towards the bottom opening of the channels, acts as a stop surface preventing insertion of the elongated bar elements 116 from the bottom 140 up. As the bar elements 116 is inserted into respective channels 146, 148 from the top 138 of wedge section 128, the resilient insulating sheath 116S of the bar element comes in contact with the sloped upper surface 150U, 152U of the detents 150, 152. The sloped surface 150U, 152U of the detents resiliently compresses the resilient sheath material allowing the bar element 116 to be inserted further into the channels 146, 148. When the recess 188 in sheath 116S is aligned with the detents 150, 152, the sheath material resiles outwards capturing the detent 150, 152 in the locating aperture 188. The inclined upper surface 150U, 152U of the detent thus abuts incline surface 191 of the locating aperture 188 thereby stopping further insertion of the bar element 116 into channel 146, 148. Lower surface 150L, 152L of the detent engages the complementing lower surface 190 of recess 188 to prevent withdrawal of the elongated bar element 116 from the wedge section 128. The complementary fit between the recess 188 in sheathing 116S of the bar element, and the detent 150, 152 protruding in the channel 146, 148 retains the bar element 116 in the web section 128.

Referring now again to FIG. 4, the elongated bar element 116S is shown in a first configuration with the sheathing 116S in position F, and in a second configuration with the resilient sheathing compressed to position G. Position F depicts the initial, or uncompressed position of the sheathing 116S of bar element 116 installed in wedge assembly 114. Insertion of the wedge assembly 114 into the shell of the connector to connect the two conductors similar to the configuration shown in FIG. 1, causes sheathing 116S on bar elements 116 to come into contact with the conductors in the shell. Further insertion of the wedge assembly into the shell biases the conductors against the bar elements 116. The bar elements 116 are retained in the wedge section by detents 150, 152 preventing movement of the bar elements relative to wedge section 128. Accordingly, the resilient sheath 116S covering the bar 116M is compressed under bias from the conductors to position G. The compressed sheath 116S" exposes the piercing protrusions 118M of the metal bar 116M. The opening 119S" in the top 113S" is expanded relative to its size when sheath 116S is uncompressed (i.e. in position F), allowing the piercing protrusions 118M to emerge from the sheath 116S" and pierce the insulation on the conductors in the connector. Sheathing 116S is similarly compressed at the bottom to expose the lower piercing protrusions 170M when inserting the wedge assembly 114 into the connector shell.

The present invention allows rapid and accurate installation of the elongated bar elements 16, 16', 116 into the wedge section 28, 28', 128 of the wedge connector wedge assembly. The user, using a connector in accordance with the present invention, need not attempt to perform adjustments on the elongated bar elements 16, 16' 116 at the same time that he is inserting the wedge assembly 14, 14', 114 into the shell, as is done in some wedge connectors of the prior art. Moreover, the elongated bar elements 16, 16', 116 are retained in the wedge section 28, 28' 128 of the present invention connector without having to be held in place by the user. Hence, in assembling the connector, the user is free to hold the wedge section 28, 28', 128 in any way he finds desirable to allow for rapid installation into the shell assembly of the connector. The wedge assemblies 14, 14' 114 may also be preassembled such that at connector installation in the field, the user removes a preassembled wedge assembly 14, 14' 114 and inserts it into the shell 12 of the connector 10. Hence, in the present invention, the user need not assemble the wedge assembly for the connector in the field, but have the wedge assembly preassembled prior to arriving in the field. This reduces the installation time for the connector, and hence, reduces the cost of the installation.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical wedge connector, comprising:

a shell;

a wedge section sized and shaped for being inserted into the shell for connecting two electrical conductors to each other, the wedge section having a one piece body with at least one passageway formed therethrough; and at least one elongated bar element mounted to the wedge section, the elongated bar element being located in said at least one passageway of the wedge section, the elongated bar element having piercing protrusions for effecting an electrical connection between each of the two conductors and the elongated bar;

wherein the wedge section has within at least one stop member for retaining the elongated bar element to the wedge section in at least one direction.

2. An electrical wedge connector in accordance with claim 1, wherein said at least one stop member has a ramp surface disposed thereon for cooperating with a locating recess in the elongated bar element when the elongated bar element is being inserted into the passageway to retain said elongated bar element in said at least one direction.

3. An electrical wedge connector in accordance with claim 1, wherein said stop member comprises a spring loaded locking member wherein when the elongated bar element is being inserted into the passageway the elongated bar element resiliently deflects the spring loaded locking member, the spring loaded locking member being biased against the elongated bar element and engaging the elongated bar element when the elongated bar element pierces one of the two conductors to retain the elongated bar element in the passageway.

4. An electrical wedge connector in accordance with claim 3, wherein when the spring loaded locking member engages the elongated bar element, the elongated bar element is in a position with the piercing protrusions out of the wedge section for piercing the two electrical conductors and forming the electrical connection between the conductors and the bar.

5. An electrical wedge connector in accordance with claim 3, wherein the elongated bar element has a locating recess formed therein for receiving the spring loaded locking member.

6. An electrical wedge connector in accordance with claim 3, wherein the spring loaded locking member comprises a resiliently flexible tab extending into the passageway, the flexible tab being angled relative to the passageway in a direction in which the elongated bar element is inserted into the passageway, and wherein the elongated bar element has a locating recess formed therein for receiving the resiliently flexible tab.

7. An electrical wedge connector in accordance with claim 6, wherein the resiliently flexible tab engages a front edge of the locating recess to prevent extraction of the elongated bar element from the passageway.

8. An electrical wedge connector in accordance with claim 1, wherein said at least one stop member comprises an internal shoulder in the passageway forming a stop surface, and the elongated bar element has a step formed therein, the step generally conforming to the shoulder in the passageway, wherein the stop surface abuts the step on the elongated bar element to prevent extraction of the elongated bar element from the passageway, and wherein when the stop surface abuts the step in the elongated bar element, the elongated bar element is in a position with the piercing protrusions out of the wedge section for piercing the two electrical conductors and forming the electrical connection between the conductors and the bar.

9. An electrical wedge connector in accordance with claim 8, wherein the passageway in the wedge section is polarized to permit insertion of the elongated bar element in one direction.

10. An electrical wedge connector in accordance with claim 1, wherein said at least one passageway has two of said stop members for retaining the elongated bar element to the wedge section in two opposite directions, the two stop members being disposed in the passageway for capturing a portion of the elongated bar element between the two stop members and holding the elongated bar element in the passageway.

11. An electrical wedge connector in accordance with claim 10, wherein a first one of the stop members engages the elongated bar element for stopping insertion of the elongated bar element into the passageway, and a second one of the stop members is resiliently biased against the elongated bar element and engages the elongated bar element to stop extraction of the elongated bar element from the passageway.

12. An electrical wedge connector in accordance with claim 11, wherein the elongated bar element has an opening formed therein, and wherein the second stop member is resiliently biased into the opening.

13. An electrical wedge connector in accordance with claim 10, wherein the passageway in the wedge section has a stop surface therein which forms a first one of the stop members, the stop surface abutting a shoulder formed in the elongated bar element to stop insertion of the elongated bar element into the passageway.

14. An electrical wedge connector in accordance with claim 10, wherein the passageway has a resiliently flexible tab cantilevered from a side of the passageway, the resiliently flexible tab forming a second one of the two stop members, and wherein the resiliently flexible tab is biased to enter into an opening in the elongated bar element to prevent extraction of the elongated bar element from the passageway.

15. An electrical wedge connector, comprising:

a shell;

a wedge section sized and shaped for being inserted into the shell for connecting two electrical conductors to each other, the wedge section having at least one passageway formed therethrough; and at least one elongated bar element mounted to the wedge section, the elongated bar element being located in said at least one passageway of the wedge section, the elongated bar element having piercing protrusions for effecting an electrical connection between each of the two conductors and the elongated bar;

wherein the wedge section includes at least one stop member for retaining the elongated bar element to the wedge section in at least one direction; and wherein said elongated bar element comprises a metal plate having said piercing protrusions at two opposite ends, and a sleeve in which said metal plate is at least partly embedded.

16. An electrical wedge connector in accordance with claim 15, wherein said sleeve is made of an overmolded insulating material.

17. An electrical wedge connector in accordance with claim 16, wherein said at least one stop member in the passageway comprises a cam surface disposed thereon for cooperating with a locating recess of the elongated bar element when the elongated bar element is being inserted into the passageway to retain said elongated bar element, and wherein when the cam surface engages said locating recess the elongated bar element is in a position with the piercing protrusions out of the wedge section for piercing the two electrical conductors and forming the electrical connection between the conductors and the bar.

18. An electrical wedge connector in accordance with claim 17, wherein said sleeve is made of resilient material displaced by the cam surface when the elongated bar element is being inserted into the wedge section.

19. An electrical wedge connector, comprising:

a shell; and a wedge assembly sized and shaped for being inserted into the shell for connecting two electrical conductors to each other, the wedge assembly comprising a wedge block and a elongated bar element located in a passageway formed into the wedge block, the elongated bar element having piercing protrusions for piercing the two conductors and electrically connecting the two conductors to the elongated bar element;

wherein the elongated bar element includes a resilient sheath, the elongated bar element having a first state in which the piercing protrusions of the elongated bar element are at least partially hidden in the resilient sheath, and a second state in which the piercing protrusions are exposed out of the resilient sheath.

20. An electrical wedge connector in accordance with claim 19, wherein insertion of the wedge assembly into the shell, against at least one of the two conductors in the shell, exposes the piercing protrusions on the elongated bar element out of the resilient sheath.

* * * * *